US011072883B2

(12) United States Patent
Monney

(10) Patent No.: US 11,072,883 B2
(45) Date of Patent: Jul. 27, 2021

(54) IRONING COACH

(71) Applicant: LAURASTAR SA, Châtel-St-Denis (CH)

(72) Inventor: Julie Monney, Châtel-St-Denis (CH)

(73) Assignee: LAURASTAR SA, Châtel-St-Denis (CH)

( * ) Notice: Subject to any disclaimer, the term of this patent is extended or adjusted under 35 U.S.C. 154(b) by 167 days.

(21) Appl. No.: 16/324,369

(22) PCT Filed: Aug. 4, 2017

(86) PCT No.: PCT/IB2017/054785
§ 371 (c)(1),
(2) Date: Feb. 8, 2019

(87) PCT Pub. No.: WO2018/029583
PCT Pub. Date: Feb. 15, 2018

(65) Prior Publication Data

US 2019/0169787 A1 Jun. 6, 2019

(30) Foreign Application Priority Data

Aug. 12, 2016 (EP) ..... 16183961

(51) Int. Cl.
*D06F 75/00* (2006.01)
*D06F 79/00* (2006.01)

(52) U.S. Cl.
CPC ..... *D06F 75/00* (2013.01); *D06F 79/00* (2013.01); *D06F 2202/12* (2013.01);
(Continued)

(58) Field of Classification Search
CPC ..... D06F 75/00; D06F 75/30; D06F 75/38; D06F 79/00; D06F 2202/12; D06F 2204/10; D06F 2210/00; D06F 2212/02
See application file for complete search history.

(56) References Cited

U.S. PATENT DOCUMENTS 6,279,832 B1 * 8/2001 Duchatelet ..... D06F 75/26 219/501
6,548,785 B1 * 4/2003 Rius ..... D06F 75/26 116/101

(Continued)

FOREIGN PATENT DOCUMENTS

WO 82/03520 10/1982
WO 2011/004295 1/2011
WO 2012/109696 A1 8/2012

OTHER PUBLICATIONS

International Search Report for PCT/IB2017/054785, dated Oct. 26, 2017, 4 pages.

(Continued)

*Primary Examiner* — Ismael Izaguirre
(74) *Attorney, Agent, or Firm* — Nixon & Vanderhye P.C.

(57) ABSTRACT

An ironing system with a coach, comprising an iron; the iron comprising at least one accelerometer; at least one magnetometer; at least one gyroscope; the ironing system further comprising a unit for determining the movement of the iron configured to make use of signals originating from the accelerometer, magnetometer and gyroscope, and calculate one or more from the list comprising a pitch axis, a yaw axis, a roll axis; and a multimedia learning system configured in particular to make use of the results originating from the movement determining unit, compare the results with an aim to be achieved for these results, and select a multimedia sequence to be presented to the user depending on the comparison.

5 Claims, 3 Drawing Sheets

(52) U.S. Cl.
CPC ..... *D06F 2204/10* (2013.01); *D06F 2210/00* (2013.01); *D06F 2212/02* (2013.01)

(56) References Cited

U.S. PATENT DOCUMENTS

| | | | | |
|---|---|---|---|---|
| 8,091,257 | B2 * | 1/2012 | Aiura | D06F 75/10 38/77.7 |
| 2006/0086712 | A1 * | 4/2006 | Feldmeier | D06F 75/26 219/250 |
| 2013/0125427 | A1 * | 5/2013 | De Vries | D06F 75/22 38/14 |
| 2014/0292101 | A1 * | 10/2014 | Baarman | H05B 6/10 307/104 |
| 2015/0239482 | A1 | 8/2015 | Green et al. | |
| 2015/0299936 | A1 * | 10/2015 | Everett, Jr. | H05B 3/74 38/77.83 |
| 2016/0168778 | A1 * | 6/2016 | Wadhwa | D06F 75/26 38/77.83 |

OTHER PUBLICATIONS

Written Opinion of the ISA for PCT/IB2017/054785, dated Oct. 26, 2017, 5 pages.
Examination Report dated Apr. 9, 2021, issued in India Application No. 201917004613, 6 pages.

* cited by examiner

IRONING COACH

This application is the U.S. national phase of International Application No. PCT/IB2017/054785 filed 4 Aug. 2017, which designated the U.S. and claims priority to EP Patent Application No. 16183961.8 filed 12 Aug. 2016, the entire contents of each of which are hereby incorporated by reference.

TECHNICAL FIELD

The present invention is in the field of ironing, and more particularly that of learning the use of an ironing device.

PRIOR ART

Linen can be ironed using an iron that a user holds in the hand and manipulates by sliding the hot iron over the linen to be ironed in an appropriate manner. The experience of the user and the specific features of the iron, and also those of the ironing board and the linen, are decisive for correct and efficient manipulation of the iron to obtain a good ironing result. The experience of the user can be constructed via empirical situations in which the user simply carries out trials with their iron and observes the result. Depending on the circumstances, the user will need more or less time to achieve a satisfactory result, and that result will not necessarily be adequate if the user is called upon to change and to adopt a new iron.

One of the problems that the invention proposes to solve is to improve the process of learning to use one's iron. It could equally well be a device combining iron and ironing board.

SUMMARY OF THE INVENTION

In a first aspect, the invention proposes an ironing system with a coach, comprising an iron; the iron comprising at least one accelerometer; at least one magnetometer; at least one gyroscope; the ironing system further comprising a unit for determining the movement of the iron configured to make use of signals originating from the accelerometer, magnetometer and gyroscope, and calculate one or more from the list comprising a pitch axis, a yaw axis, a roll axis; and a multimedia learning system configured in particular to make use of the results originating from the movement determining unit, compare the results with an aim to be achieved for these results, and select a multimedia sequence to be presented to the user depending on the comparison.

In one preferred embodiment, the ironing system further comprises a multimedia terminal, a wireless communication device configured to broadcast the results originating from the movement determining unit to the multimedia terminal, the multimedia terminal being configured to include the learning system.

In a further preferred embodiment, the wireless communication device is a Bluetooth® device.

In a further preferred embodiment, the multimedia terminal is a smartphone.

In a further preferred embodiment, the multimedia learning system is further configured to teach the user a particular function integrated in the ironing system.

In a second aspect, the invention proposes an ironing coaching method intended for a user, comprising a measurement of the movement of an iron; a comparison of the movement measurements with an aim to be achieved for the movement; and a formulation of instructions intended for the user on the basis of the result of the comparison of the measurements, the instructions being formulated to encourage the user to adjust the movement in order to achieve the aim to be achieved for the movement.

In a further preferred embodiment, the instruction broadcasting step involves a multimedia terminal.

In a further preferred embodiment, signals are exchanged between the iron and the multimedia terminal by means of a of a wireless communication device.

BRIEF DESCRIPTION OF THE DRAWINGS

The invention will be better understood in the light of the detailed description of embodiments with reference to the figures in which.

DETAILED DESCRIPTION

Figure 1:
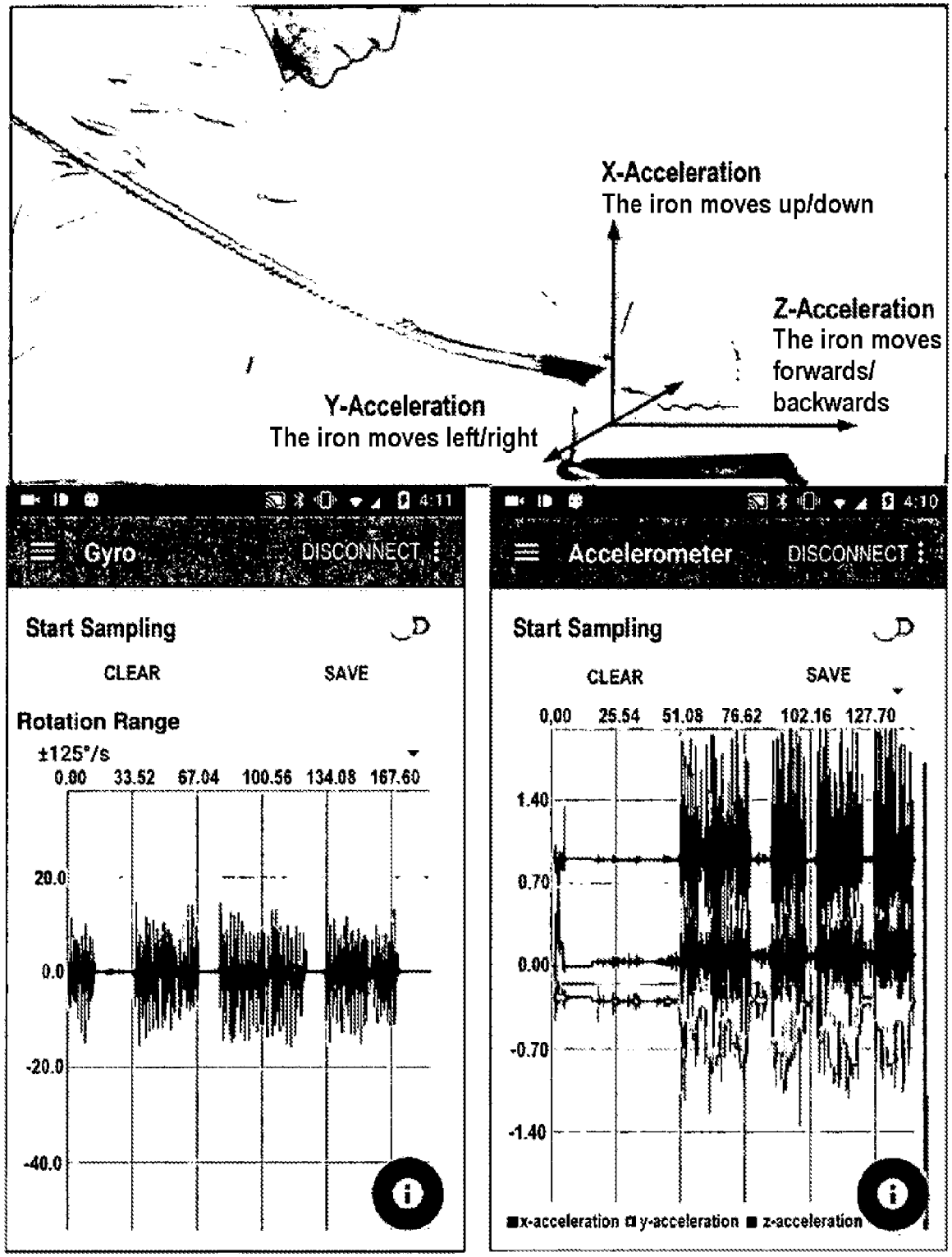
FIG. 1 shows an ironing system according to one embodiment of the invention.

FIG. 1 shows in it middle part a user holding in their hand the handle of an iron.

The iron is an element of an ironing system with a coach.

The term coach is used to designate a set of features cooperating to produce an effect of teaching the user, notably during an ironing session.

Accordingly the iron comprises at least one accelerometer, at least one magnetometer, and at least one gyroscope. In the FIG. 1 illustration these three elements are for example integrated into the handle of the iron. In one preferred embodiment, the iron comprises a sensor with nine axes including accelerometers for the three directions in space here termed x, y, z, gyroscopes for x, y, z, and magnetometers for x, y, z. Sensors of this type are known to the person skilled in the art and already used in numerous electronic devices and so we will not describe them in more detail here.

In FIG. 1, for example, the functions of the accelerometers are indicated by text superimposed on the photo of the user, accompanied by arrows showing which directions of the iron are measured.

The ironing system further comprises a unit for determining the movement of the iron configured to make use of signals originating from the accelerometer, magnetometer and gyroscope, and to calculate one or more from the list comprising a pitch axis, a yaw axis, a roll axis.

The unit for determining the movement of the iron may for example comprise a software module executed on a multimedia terminal. The latter may be integrated into the iron, but in one preferred embodiment it may be a smartphone.

The graphic on the right below the user in FIG. 1 shows results of measurements in time for three accelerometer directions, as displayed on the screen of a smartphone executing the software module for the unit for determining the movement of the iron.

The graphic on the left below the user in FIG. 1 shows results of measuring in time for a gyroscope, as displayed on the screen of a smartphone executing the software module for the unit for determining the movement of the iron.

The ironing system further comprises a multimedia learning system configured in particular to make use of the results originating from the movement determining unit, compare the results with an aim to be achieved for those results, and select a multimedia sequence to be presented to the user depending on the comparison. In the end, the sensor integrated into the iron is a means that enables optimization of the gesture of the user by comparing it to the ideal gesture shown for example in an interactive video, transforming the system into a coach.

Figure 2:
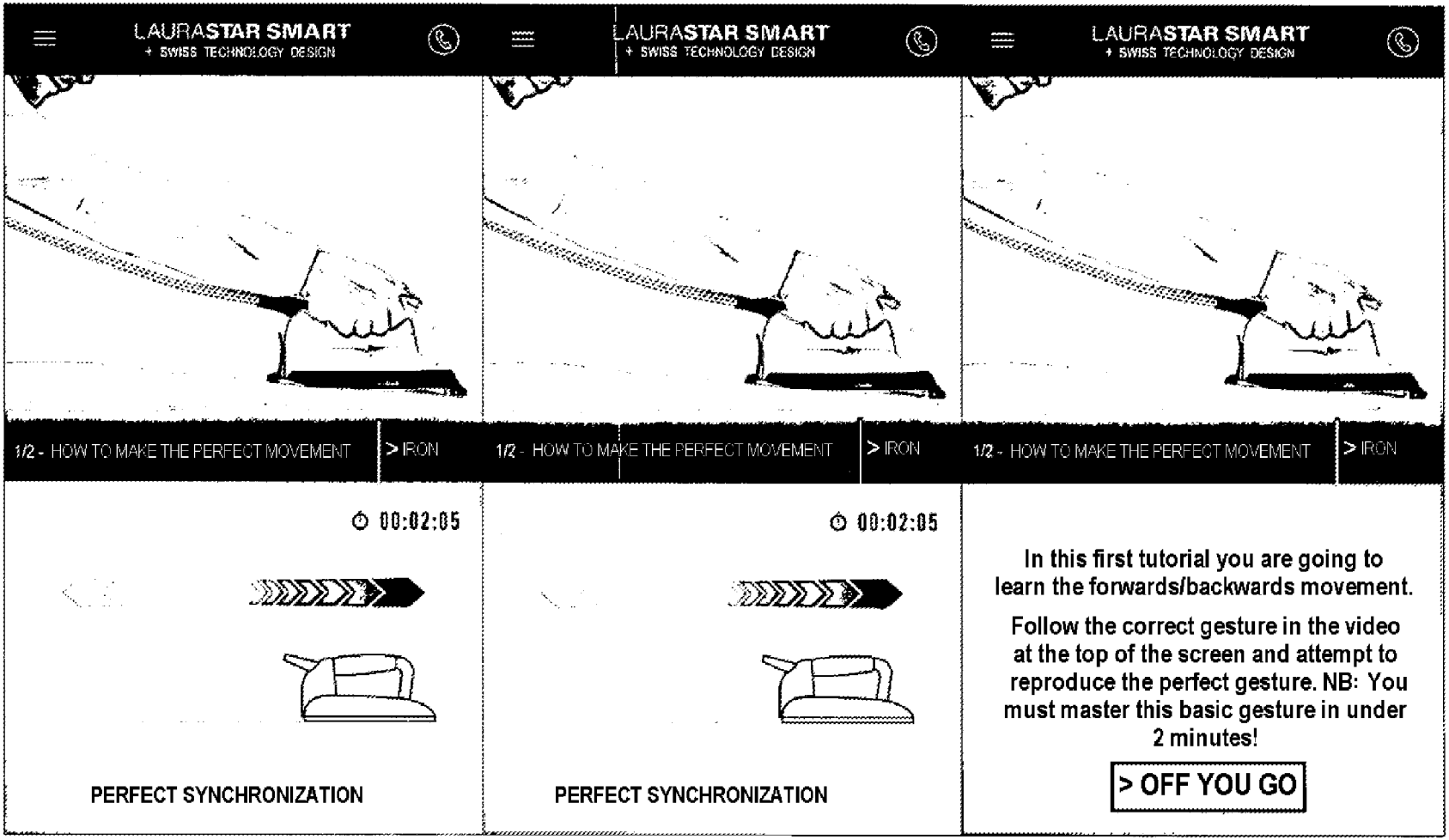
FIG. 2 shows screens produced on a multimedia terminal in one preferred embodiment of the invention.

FIG. 2 contains three displays on a smartphone, produced by the learning system to make use of the results coming from the movement determining unit. The three displays are represented in "landscape" mode on the FIG. 2 page so that the display on the left is at the bottom of the page and that on the right at the top of the page.

The one on the left in FIG. 2 shows the learning system in a mode intended to teach an ironing movement. The part at the top of the display showing the arm of the user holding the iron is representative of a video illustrating the partial or total movement to be imitated by the user. The half at the bottom of the display is a text explaining to the user the objective of the teaching and the instructions to be followed. A button at the bottom of the display screen enables the learning session as such to be started.

The one in the middle in FIG. 2 shows another screen of the mode intended to teach the ironing movement, but rather while the user is moving the iron and the movement of the iron is measured and analyzed to compare it with the aim to be achieved. The part at the bottom indicates a message "perfect synchronization" signifying that the user has achieved its aim.

The one on the right in FIG. 2 shows the learning system in a mode intended to teach the user a particular function integrated into the ironing system. In the example shown the feature aims to teach the activation of a fan function corresponding to a blower in the ironing board by means of a fan button that is situated at the front of the iron. Other examples of particular functions can be envisaged in other embodiments not shown or discussed here, the functions being known in themselves.

In the embodiment discussed above, with the 9-axis sensor including accelerometers for the three directions in space here termed x, y, z, gyroscopes for x, y, z, and magnetometers for x, y, z, the unit for determining movement of the iron is configured to calculate a pitch axis, a yaw axis and a roll axis, and these three values are used to detect how the iron is moved, laid on the ironing board, in the air or in any other dynamic or static position. In one preferred embodiment, a PCB type accelerometer, based in particular on piezo sensors, delivers results for detecting movement on two or three axes, and it is therefore possible to detect if a correct backwards or sideways movement is effected by the user.

In one preferred embodiment, the ironing system that comprises a multimedia terminal further comprises a wireless communication device configured to broadcast the results originating from the movement determining unit to the multimedia terminal, the multimedia terminal being configured to include the learning system. The wireless communication device may for example be a Bluetooth® device.

Figure 3:
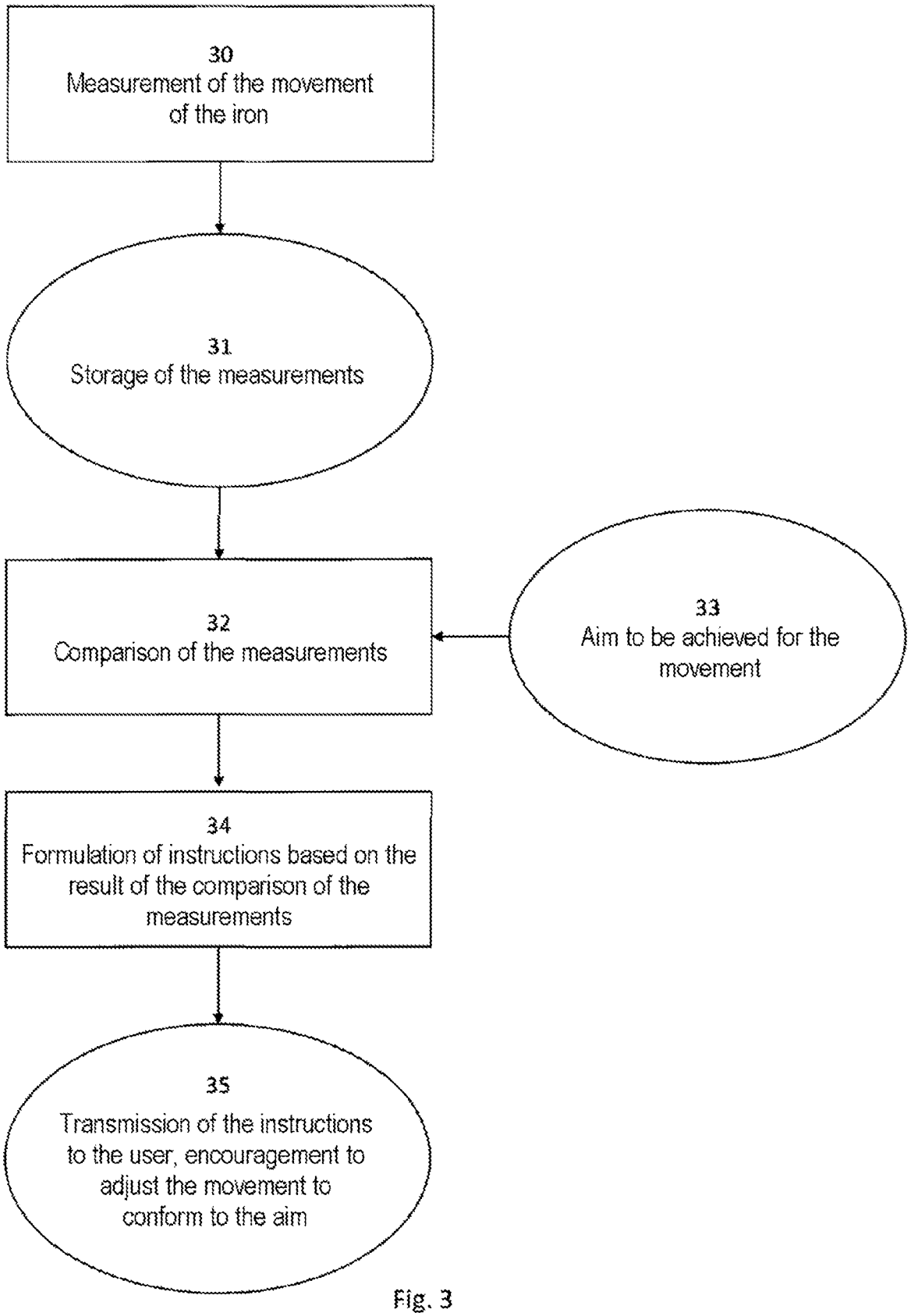
FIG. 3 contains a flowchart representing one embodiment of the method according to the invention.

FIG. 3 shows a flowchart of the inventive ironing coaching method.

The ironing coaching method intended for a user comprises a measurement 30 of the movement of an iron; a comparison 32 of the movement measurements 31 to an aim 33 to be achieved for the movement; and a formulation 34 of instructions 35 intended for the user on the basis of the results of the comparison of the measurements, the instructions being formulated to encourage the user to adjust the movement in order to achieve the aim to be achieved for the movement.

The examples of systems and methods described above are not limiting. The scope of the invention is given by the claims.

The invention claimed is:

1. An ironing system with a coach, comprising:

an iron having an accelerometer, a magnetometer, and a gyroscope, a unit for determining a movement of the iron, the unit configured to use signals from the accelerometer, the magnetometer and the gyroscope, and to calculate at least one of a pitch axis, a yaw axis, and/or a roll axis;

a multimedia terminal including a multimedia learning system configured to use results from the unit for determining the movement, compare the results with a desired movement, and to select a multimedia sequence to present to the user on the multimedia terminal depending on the comparison; and a wireless communication device configured to broadcast the movement determined by the unit for determining the movement to the multimedia terminal.

2. The ironing system as claimed in claim 1, wherein the wireless communication device is a Bluetooth device.

3. The ironing system as claimed in claim 1, wherein the multimedia terminal is a smartphone.

4. The system as claimed in claim 1, wherein the multimedia learning system is further configured to teach the user a particular function integrated in the ironing system.

5. An ironing coaching method intended for a user, comprising the steps of:

measuring movement of an iron;

broadcasting data of the movement to a multimedia terminal with a wireless communication device;

comparing the movement measurements with a desired movement with a multimedia learning system at the multimedia terminal;

providing instructions to the user on a basis of a result of the comparison of the measurements by the multimedia terminal, the provided instructions formulated to encourage the user to adjust the movement to achieve the desired movement.

* * * * *